United States Patent [19]

Appel

[11] 4,028,843

[45] June 14, 1977

[54] CHILD'S TOY

[75] Inventor: Mel Appel, Livingston, N.J.

[73] Assignee: Gabriel Industries, Inc., New York, N.Y.

[22] Filed: May 12, 1976

[21] Appl. No.: 685,562

[52] U.S. Cl. ..... 46/1 R; 46/59

[51] Int. Cl.[2] ..... A63H 33/00

[58] Field of Search ..... 46/1 R, 32, 59, 177

[56] References Cited

UNITED STATES PATENTS

| | | | |
|---|---|---|---|
| 3,615,092 | 10/1971 | Stubbmann | 46/59 |
| 3,727,583 | 4/1973 | Muraro | 46/59 |
| 3,803,735 | 4/1974 | Stubbmann | 46/32 |

*Primary Examiner*—Louis G. Mancene
*Assistant Examiner*—Robert F. Cutting
*Attorney, Agent, or Firm*—Seidel, Gonda & Goldhammer

[57] ABSTRACT

A turtle-shaped frame provided with a recess and a post located within and projecting outwardly from the recess. A plurality of balls are freely disposed within the recess. A hub is rotatably mounted on the frame post and is spaced apart from the recess perimeter to provide a channel within which the balls can be moved. The hub has a flexible projecting member for yieldingly striking at least one of the balls upon rotation of the hub with respect to the post. The hub has a hollow shaft portion to which are connected means for causing bidirectional rotation of the hub. Means are depressably mounted in the frame for producing an audible sound. Means are coupled to the frame for mounting the frame to a crib rail.

17 Claims, 7 Drawing Figures

FIG. 1
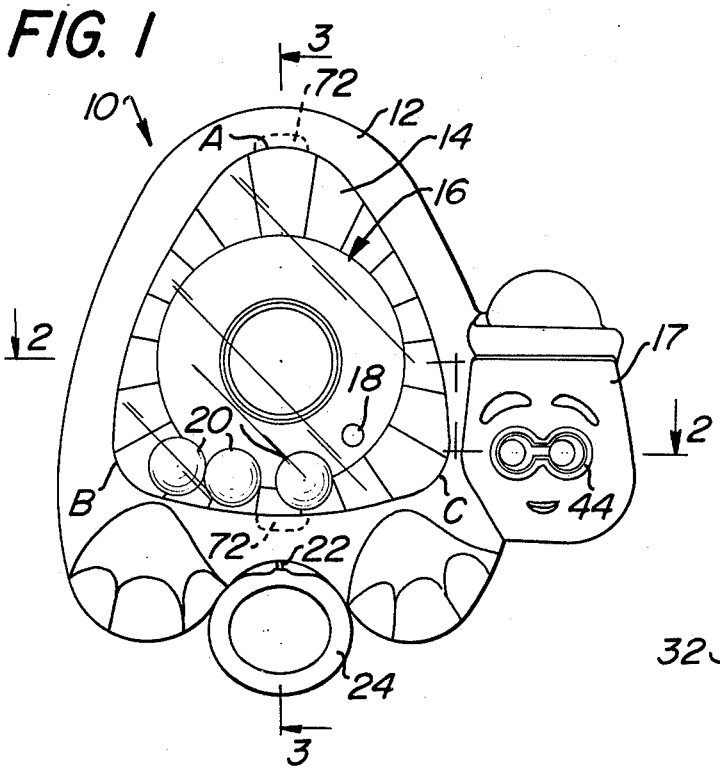
FIG. 3
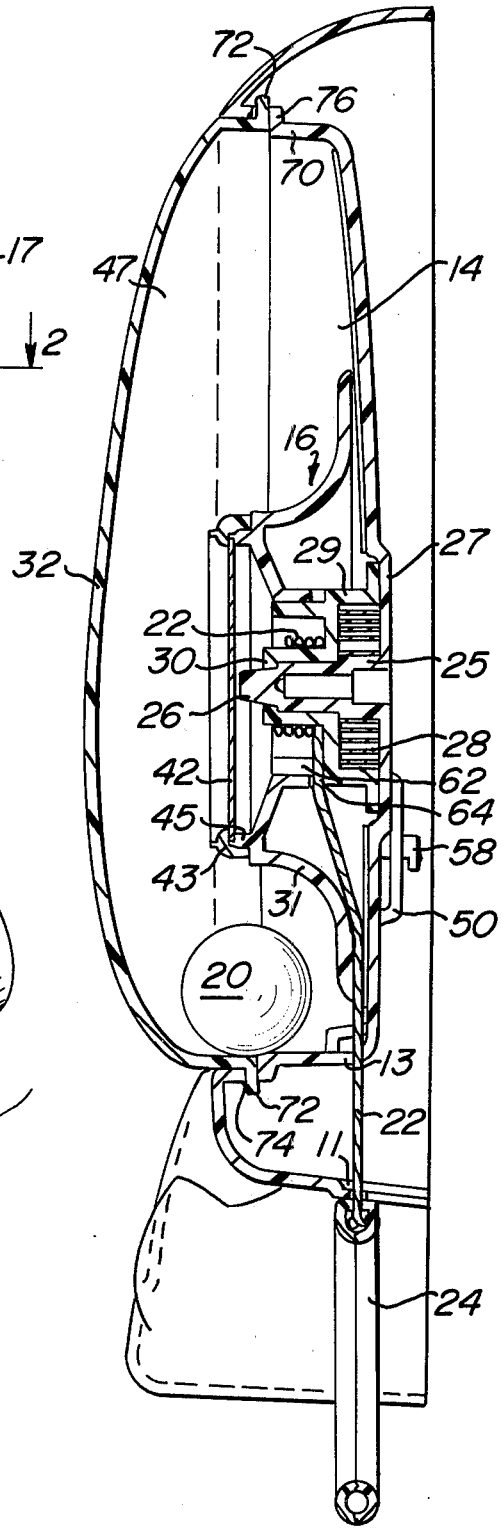
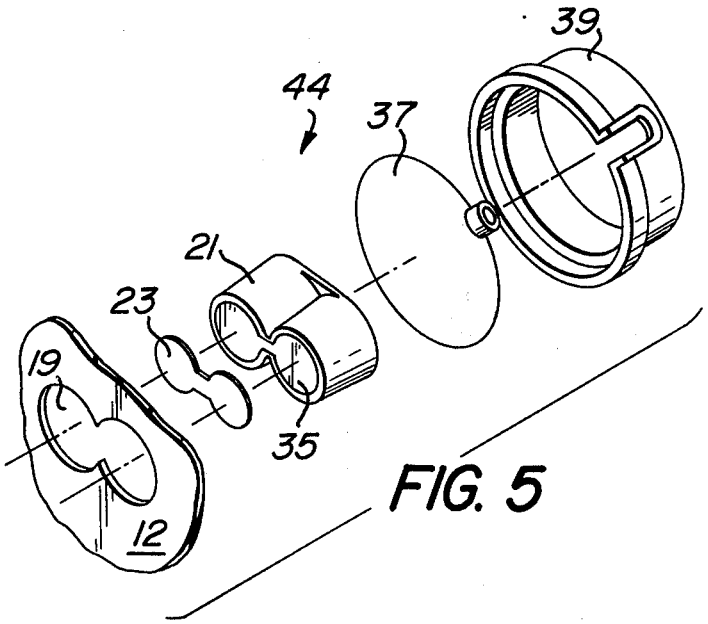
FIG. 5

CHILD'S TOY

BACKGROUND OF THE INVENTION

The present invention relates to a child's toy which produces a variety of visual and audible impressions. In particular, the present invention relates to a child's toy including one or more movable elements for producing a visual impression of motion as well as audible impressions such as rattling and other sounds. The audible and visible impressions need not be coterminous.

It is known in the art to enclose a plurality of balls in a partially transparent casing, and to strike or propel the balls by use of one or more rigid arms rotatably mounted on a shaft disposed within the casing. The arms may be mounted so as to rotate in response to displacement of the casing itself, as in U.S. Pat. No. 3,190,036 issued to Motley, or the arms may be driven independently of the casing as indicated in U.S. Des. Pat. No. Des. 232,576 issued to Langieri.

Such devices, however, are not suitable for manipulation by an infant in a crib. Specifically, such devices cannot be vertically mounted in a substantially stationary manner on a crib rail for operation by the infant. Either the casing itself must be displaced to cause operation of the arms or the casing must be secured in a substantially horizontal plane.

It is also known in the art to use a rotatably mounted pulley coupled to an energy storing means to produce general rotational motion of a casing in which a plurality of balls are freely disposed as shown in U.S. Pat. No. 3,060,628 issued to Palmer. Rotation of the casing results in agitation of the balls disposed therein without having to strike the balls with any arm-like members. In such an arrangement, the pulley is rotatably mounted exterior to the casing and in driving engagement therewith. Thus, it can be readily appreciated that the prior art does not disclose a child's toy which is easily mounted in a substantially stationary position on a crib rail and which provides for the manipulation by an infant of a member exterior to the toy casing by which a plurality of balls disposed within the casing can be agitated to produce a visual impression of motion and a rattling noise, all without displacement of the casing itself.

BRIEF SUMMARY OF THE INVENTION

A child's toy, comprising a frame having a recess therein and a hub rotatably mounted on the frame within the recess. The hub has a flexible projecting member for yieldingly striking at least one ball located within the frame recess upon rotation of the hub with respect to the frame. Means are provided for rotating the hub from a rest position with respect to the frame and for automatically returning the hub to the rest position. A dome secured to the frame covers the recess and the hub. Means are coupled to the frame for mounting the frame on a crib rail.

An advantage of the present invention is that a plurality of balls freely disposed within a frame or a casing can be agitated to produce a rattling noise without displacement of the frame itself.

Another advantage of the present invention is that the member employed to propel the balls is flexible and can be rotated in a first direction without agitation of the balls and a second direction with agitation of the balls.

A further advantage of the present invention is that it can be easily mounted in a substantially stationary manner on a crib rail and manipulated by an infant.

A still further advantage of the invention is that it provides a multiplicity of impressions, audible and visual, to the infant.

For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 1 is a front view of the child's toy constructed in accordance with the principles of the present invention.

FIG. 3 is a right side view in cross section of the child's toy in FIG. 1.

FIG. 5 is an exploded view of another part of the child's toy in FIG. 1 for producing an audible sound.

DETAILED DESCRIPTION OF THE INVENTION

Figures 2, 4, 6, 7:
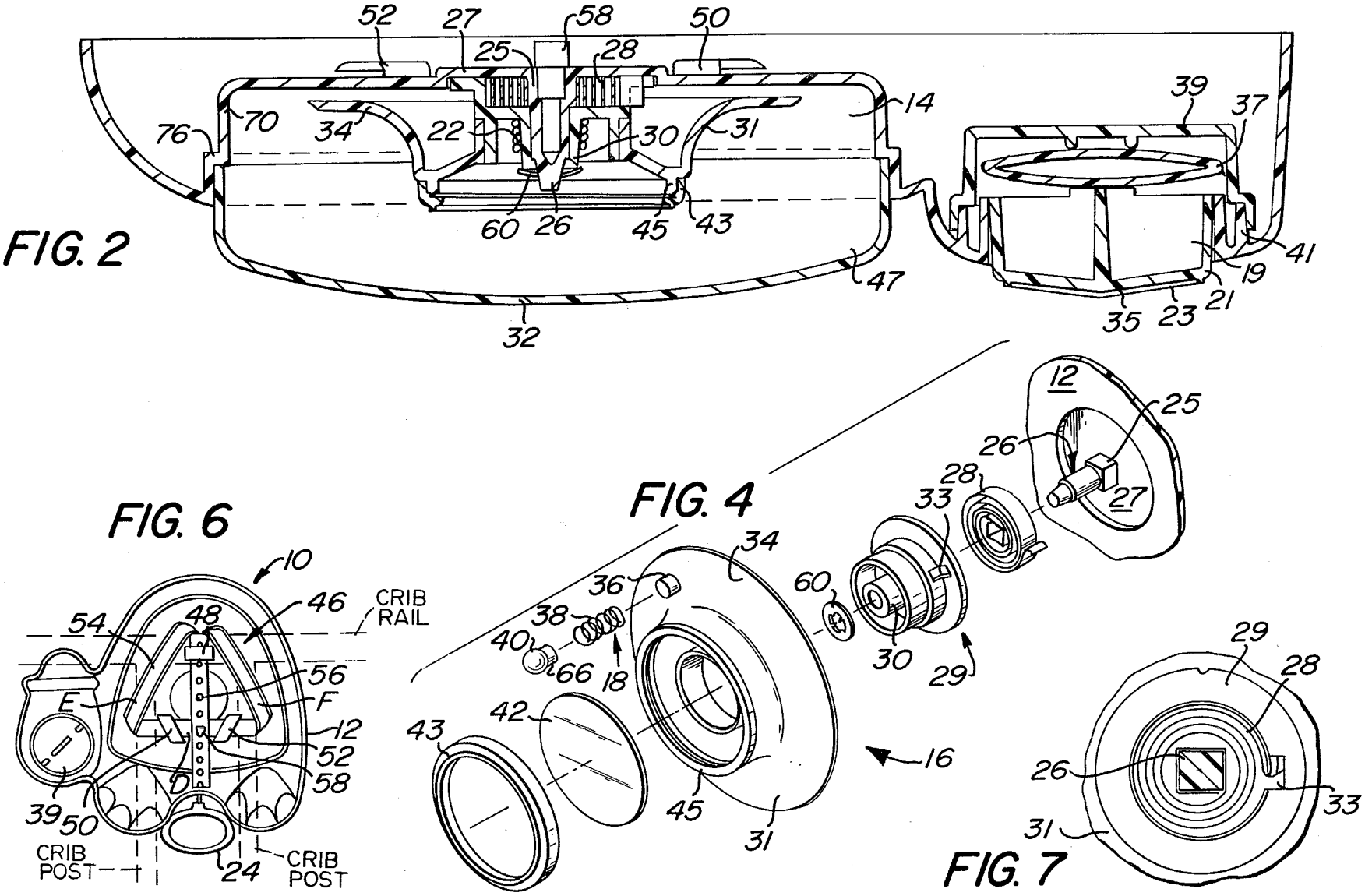
FIG. 2 is a top view in cross section of the child's toy in FIG. 1.
FIG. 4 is an exploded view of one part of the child's toy in FIG. 1, for propelling one or more balls therein.
FIG. 6 is a rear view of the child's toy in FIG. 1.
FIG. 7 is a cross-sectional view of part of the structure of FIG. 4.

Referring to the drawings in detail, wherein like numerals indicate like elements, there is shown in FIG. 1 a child's toy constructed in accordance with the principles of the present invention, designated generally as 10.

A frame 12 is made of plastic and is shaped generally in the design of a fanciful animal figure such as a turtle with a derby hat. See FIG. 1. Frame 12 has a wall 70 which defines triangularly shaped recess 14 having smoothed vertices A, B, and C. See FIGS. 2 and 3. A hub 16 having a flexible projecting member 18 is rotatably mounted on frame 12 within recess 14.

A transparent dome 32 encloses hub 16 and recess 14. Dome 32 is seated on shoulder 76 in wall 70. The dome is provided with one or more mounting flanges 72 which fit within one or more slots 74 in wall 70 near shoulder 76 to hold the dome in position.

Hub 16 is connected by means of a cord 22 to a pull ring 24. By pulling ring 24, hub 16 is caused to rotate with respect to frame 12. As hub 16 rotates, flexible projecting member 18 strikes one or more balls 20 which are freely disposed within channel 47 defined by hub, wall 70 and dome 32. See FIGS. 2 and 3.

Recess 14 is provided with a circular depression 27. See FIG. 3. A frame post 26 is located within and projects outwardly from depression 27. It is preferred that frame post 26 be formed integrally with frame 12 with a rectangular base portion or shoulder 25. Internal hub member 29 is rotatably mounted on frame post 26. Hollow shaft portion 30 of hub member 29 is seated on post base 25 and clamped in place by pushnut fastener 60. See FIG. 2. External hub member 31 is securely engaged to internal hub member 29 by means of an adhesive or the like. A cord 22 is anchored at one end to hollow shaft portion 30 of internal hub member 29 by means of a clip (not shown) or other conventional fastening device. See FIG. 3. The cord leaves frame 12 through slots 62 and 64 in members 29 and 31 and openings 11 and 13 in frame 12. Cord 22 is anchored at its other end to pull ring 24 outside frame 12. When ring 24 is pulled, cord 22 unrolls about hollow shaft portion 30 causing hub 16 to rotate about frame post 26.

When cord 22 has been extended to a desired length and pull ring 24 released, hub 16 returns to its original or rest position under the return force of coil spring 28. Coil spring 28 is anchored at one end portion to the rectangular base portion 25 of frame post 26 by deformably wrapping the spring end portion around the frame post base. The other end portion of coil spring 28 is anchored in slot 33 in internal hub member 29. See FIG. 4. Thus, as cord 22 is caused to unwind by pulling ring 24, hollow shaft portion 30 of internal hub member 29 (hence hub 16) is caused to rotate about frame post 26. At the same time, coil spring 28 is caused to wind about frame post base 25. When ring 24 is released, spring 28 unwinds, causing hollow shaft portion 30 (hence hub 16) to rotate in the opposite direction. Hub 16 is thereby caused to alternatively rotate away from and back to its original or rest postion.

Hub 16 is provided with a stub 36 integrally formed on the flanged portion 34 of external hub member 31. See FIG. 4. A helical spring 38 is wound around stub 36 at one end. Stub 36 may be threaded to assist in anchoring the spring thereto. At its other end, spring 38 is wound around the shaft portion 66 of knob 40. The shaft portion of knob 40 may also be threaded to assist in anchoring the spring thereto. Thus, stub 36, spring 38 and knob 40 form the flexible projecting member 18.

When hub 16 is rotated, flexible member 18 strikes one or more balls 20. Typically, when the infant pulls rings 34, hub 16 rotates relatively slowly. As a result, flexible member 18 yieldingly contacts and slides over the balls 20. Specifically, helical spring 38 temporarily deforms upon contact with the balls 20 so that the balls remain relatively undisturbed while member 18 glides past them. During this time, coil spring 28 winds. When cord 22 has been extended a desired length and ring 24 released, spring 28 unwinds under its return force. As spring 28 unwinds, hub 16 is caused to rotate quickly. In other words, hub 16 is snapped back to its original or rest position by spring 28. As the hub returns to its rest position, flexible projecting member 18 contacts balls 20, propelling the balls in channel 47. As the balls travel in the channel, they rebound against the frame 12, hub 16 and dome 32 making a rattling sound to grasp the infant's attention.

In addition to the visual and audible stimulation supplied by the movement of the balls 20 within recess 14, depressable means 44 are mounted in the head portion 17 of frame 12 to provide a separate audible sound to fascinate the infant. See FIG. 1. In the preferred embodiment, means 44 are mounted to simulate the eyes in the turtle-shaped frame 12. Thus, head portion 17 of frame 12 is provided with a pair of overlapping circular openings 19 to simulate the eye sockets of the turtle figure. Depressable member 21, in the shape of two overlapping frustrums, is disposed within openings 19. See FIGS. 2 and 5. Preferably, member 21 is a single integral piece made of plastic. A cut-out 23 in the form of two eyeballs is applied by adhesive to the exposed top surface 35 of member 21.

Member 21 rests on a bellows-type element 37 which emits a squeaking sound when it is deflated. See FIG. 3. Element 37 is supported by interior housing 39 which is secured by means of adhesive or the like to internal circular wall 41. When member 21 is depressed inwardly, it presses against bellows-type element 37 causing the element to deflate. As element 37 deflates, it emits a squeaking noise. When member 21 is released, element 37 inflates, pushing member 21 outwardly to return the member to its non-depressed or rest position.

For additional visual stimulation, hub 16 is provided with a reflective member 42 at its central top portion. Reflective member 42 may be a circular polished piece of metal or other reflective surface. Member 42 is seated on an annular lip 45 at the central top portion of external hub member 31. See FIGS. 2 and 3. Member 42 is secured in place by a circular cap 43. See FIGS. 3 and 4. Reflective member 42 reproduces the image of the infant's face when the infant first looks at the toy. Thus, member 42 provides an additional visual impression to fascinate and amuse the infant without necessarily operating the toy.

Frame 12 can be mounted in a substantially stationary manner on a crib rail by mounting means 46. The arrangement for securing the child's toy 10 to a crib rail is shown in FIG. 6. The crib rail and crib posts are shown in phantom. The toy 10 can be operated by an infant in the crib while the frame remains stationary. Thus, the member 21 can be depressed to create the squeaking noise or the ring 24 can be operated to rattle the balls 20 while frame 12 remains mounted on the crib rail.

Means 46 comprises three loops 48, 50 and 52 integrally formed in frame 12 for receiving a plastic belt 54. Belt 54 is threaded through loops 48, 50 and 52 to form a triangular figure having a base portion D and side portions E and F. See FIG. 6 The belt is provided with a plurality of holes 56 to adjust the position of the toy on the crib rail. Preferably, the base D is provided with a hole (not numbered) at its center for securing belt 54 to a hook-like catch 58 integrally formed in the rear of frame 12. See FIG. 3. The catch retains belt 54 in position with base portion D remaining flat along the rear of frame 12.

To mount toy 10 so that it can be operated by an infant in the crib, the toy is positioned with its rear against the crib rail and posts shown facing into the crib. Belt 54 is threaded through loops 50 and 52, wrapped around adjacent crib posts and brought over the top of the crib rail. The ends of belt 54 are then threaded through loop 48. Catch 58 passes through one of the holes 56 in each end portion of the belt to keep the belt in place and the toy stationary along the crib rail. The toy can be raised or lowered with respect to the crib rail by merely passing catch 58 through different holes 56 in the belt.

With the child's toy mounted on the crib rail, the infant can look at the reflective member 42, depress the means 44 for producing the squeaking sound or pull the ring 44 to agitate the balls 20. Thus, the only physical movements required to operate the toy are pulling the ring 24 and depressing the means 44. Since the frame 12 itself does not move once it is mounted on the crib rail, the pull ring 24 and the means 44 may even be simultaneously activated.

It should be understood that the present invention is not limited to a particular animal shape for frame 12. Nor is the invention limited to a particular shape for recess 14 in frame 12. Thus, frame 12 could be in the shape of a flower and recess 14 could be circular. In addition, although it is preferred that certain of the elements described herein be integrally formed with frame 12, it should be understood that the elements might also be separate pieces secured to the frame by adhesive or the like. Further, although certain of the elements have been described as being made of plastic, it should be understood that other materials which are equivalent for the purposes described herein may also be used within the spirit and scope of the invention.

The present invention may be embodied in other specific forms without departing from the spirit or essential attributes thereof and, accordingly, reference should be made to the appended claims, rather than to the foregoing specification as indicating the scope of the invention.

What is claimed is:

1. A child's toy, comprising:

a frame having a recess therein;

a hub rotatably mounted on said frame within said recess, said hub having a flexible projecting member for yieldingly striking at least one ball located within said frame recess upon rotation of said hub with respect to said frame;

means for rotating said hub from a rest position with respect to said frame;

means for automatically returning said hub to said rest postion; and a dome secured to said frame, said dome covering said recess and said hub.

2. The child's toy according to claim 1 wherein said frame is provided with a post located within and projecting outwardly from said recess and said hub is rotatably mounted on said post.

3. The child's toy according to claim 2 wherein said means for automatically returning said hub to said rest position includes a coil spring wound around said post, one end of said spring being engaged with said post and the other end of said spring being engaged with said hub whereby rotation of said hub from said rest position causes said spring to wind.

4. The child's toy according to claim 3 wherein said hub includes a hollow shaft portion enclosing at least part of said post in rollable contact therewith and said means for rotating said hub includes a cord attached at one end to and wrapped around said hollow shaft and a pull ring attached to the other end of said cord.

5. The child's toy according to claim 1 wherein said dome is transparent.

6. The child's toy according to claim 1 wherein said hub includes a flanged portion provided with a stud shaped member projecting therefrom and said flexible projecting member includes a helical spring and a knob having a shaft, one end portion of said helical spring being securely wrapped around said stub shaped member and the other end portion of said spring being wrapped around said knob shaft.

7. The child's toy according to claim 1 wherein said hub has a reflective surface at its upper central portion.

8. The child's toy according to claim 1 including means depressably mounted in said frame and spaced apart from said recess for producing an audible sound.

9. The child's toy according to claim 1 including means coupled to said frame for mounting said frame on a crib rail.

10. A child's toy comprising:

a frame having a recess therein and a post located within and projecting outwardly from said recess;

a plurality of balls freely disposed within said frame recess;

a hub rotatably mounted on said frame post, said hub having a flexible projecting member for yieldingly striking at least one of said balls upon rotation of said hub with respect to said post;

means for causing bi-directional rotation of said hub;

a dome secured to said frame, said dome covering said recess and said hub; and means coupled to said frame for mounting said frame on a crib rail.

11. The child's toy according to claim 10 wherein said means for causing bi-directional motion of said hub includes means for rotating said hub from a hub rest position and a coil spring for automatically returning said hub to the rest position, said coil spring being wound around said post, one end of said spring being engaged with said post and the other end of said spring being engaged with said hub whereby rotation of said hub from the rest position causes said spring to wind.

12. The child's toy according to claim 10 wherein said dome is transparent.

13. The child's toy according to claim 10 wherein said hub includes a flanged portion provided with a stud shaped member projecting therefrom and said flexible projecting member includes a helical spring and a knob having a shaft, one end portion of said helical spring being securely wrapped around said stub shaped member and the other end portion of said spring being wrapped around said knob shaft.

14. The child's toy according to claim 10 wherein said hub has a reflective surface at its upper central position.

15. The child's toy according to claim 10 including means depressably mounted in said frame and spaced apart from said recess for producing an audible sound.

16. A child's toy comprising:

a frame having a recess therein and a post located within and projecting outwardly from said recess;

a plurality of balls freely disposed within said frame recess;

a hub rotatably mounted on said frame post within said recess and spaced apart from the recess perimeter to provide a channel within which said balls can be moved, said hub having a flexible projecting member for yieldingly striking at least one of said balls upon rotation of said hub with respect to said post to cause the balls to travel within said recess channel;

means for causing bi-directional rotation of said hub with respect to a hub rest position;

a dome secured to said frame, said dome covering said recess and said hub; and means coupled to said frame for mounting said frame on a crib rail.

17. The child's toy according to claim 16 including means depressably mounted in said frame and spaced apart from said recess for producing an audible sound.

* * * * *